US007275657B2

(12) United States Patent
Geyer

(10) Patent No.: US 7,275,657 B2
(45) Date of Patent: Oct. 2, 2007

(54) BAG DISPENSER

(75) Inventor: Thomas E. Geyer, West Chester, OH (US)

(73) Assignee: Ampac Plastics LLC, Cincinnati, OH (US)

( * ) Notice: Subject to any disclaimer, the term of this patent is extended or adjusted under 35 U.S.C. 154(b) by 315 days.

(21) Appl. No.: 10/426,581

(22) Filed: Apr. 30, 2003

(65) Prior Publication Data

US 2004/0217121 A1 Nov. 4, 2004

(51) Int. Cl.
*A47K 10/24* (2006.01)
*B65H 1/00* (2006.01)

(52) U.S. Cl. ..... 221/52; 221/56; 221/58; 221/33

(58) Field of Classification Search ..... 221/56, 221/53, 63, 303, 305, 52, 58, 33; 206/554; D6/516

See application file for complete search history.

(56) References Cited

U.S. PATENT DOCUMENTS

| | | | | | |
|---|---|---|---|---|---|
| 1,909,919 | A | * | 5/1933 | Nicholas | 206/355 |
| 2,636,599 | A | * | 4/1953 | Willis et al. | 221/48 |
| 2,884,162 | A | * | 4/1959 | Crebbs | 221/46 |
| 3,162,305 | A | * | 12/1964 | Schoppa, Jr. | 206/493 |
| 3,195,772 | A | | 7/1965 | Buttery | 221/33 |
| 3,381,852 | A | * | 5/1968 | Bastian | 221/44 |
| 3,395,830 | A | | 8/1968 | Buttery | 221/63 |
| 3,422,988 | A | * | 1/1969 | Lafranca | 221/58 |
| 3,456,843 | A | * | 7/1969 | Planner | 221/63 |
| 3,482,734 | A | | 12/1969 | Mierson | 221/63 |
| 3,603,452 | A | * | 9/1971 | Singer | 206/761 |
| 3,624,791 | A | * | 11/1971 | Taub | 221/59 |
| 3,724,716 | A | * | 4/1973 | Baraconi et al. | 221/47 |
| 3,881,632 | A | * | 5/1975 | Early et al. | 221/50 |
| 4,044,919 | A | | 8/1977 | Olson | 221/63 |
| 4,527,693 | A | * | 7/1985 | Membrino | 206/554 |
| 4,537,330 | A | * | 8/1985 | Gelbard | 221/26 |
| 4,566,607 | A | | 1/1986 | Smith | 221/155 |
| 4,611,728 | A | | 9/1986 | Compton et al. | 221/63 |
| 4,645,108 | A | | 2/1987 | Gavin et al. | 225/103 |
| 4,953,747 | A | * | 9/1990 | Wenkman et al. | 221/45 |
| 4,989,801 | A | * | 2/1991 | Thomas et al. | 242/588 |
| 4,995,530 | A | * | 2/1991 | Tabor | 221/46 |
| 5,042,687 | A | * | 8/1991 | McKinley | 221/311 |
| 5,116,012 | A | * | 5/1992 | Offenhauer et al. | 248/452 |
| 5,363,985 | A | * | 11/1994 | Cornell | 221/46 |
| 5,390,819 | A | * | 2/1995 | Kaye | 221/45 |
| 5,390,820 | A | * | 2/1995 | Wright et al. | 221/52 |
| 5,417,345 | A | * | 5/1995 | Smith | 221/33 |
| 5,509,570 | A | | 4/1996 | DeMatteis | 221/33 |

(Continued)

*Primary Examiner*—Saul Rodriguez
*Assistant Examiner*—Michael E Butler
(74) *Attorney, Agent, or Firm*—Wood, Herron & Evans, LLP

(57) ABSTRACT

A container for individually dispensing plastic bags provided in a stack. The container is formed from a blank that is cut and formed with appropriate fold lines, such that when assembled, the container includes a bottom wall, spaced, opposing sidewalls, and spaced, opposing front and back walls. The bottom wall, sidewalls, and front and back walls define a receptacle for receiving a stack of bags. The container further includes an interior flap extending between the front and back walls. The flap is biased in a direction toward one of the front and back walls such that the flap engages the stack of bags and helps to maintain the stack in a desired orientation within the receptacle.

10 Claims, 3 Drawing Sheets

U.S. PATENT DOCUMENTS 5,678,728 A * 10/1997 Leto ..... 221/185
5,927,516 A * 7/1999 Berry ..... 211/51
5,939,161 A * 8/1999 Callahan et al. ..... 428/40.1
6,079,190 A * 6/2000 Simpson ..... 53/492
6,098,806 A 8/2000 Mills ..... 206/554
6,179,126 B1 * 1/2001 Smithson et al. ..... 206/554
6,349,525 B1 * 2/2002 Veith ..... 53/429
6,378,733 B1 4/2002 Boonzaier ..... 222/105
6,550,636 B2 * 4/2003 Simpson ..... 221/59
6,719,472 B2 * 4/2004 Windorski et al. ..... 401/195
6,749,084 B2 * 6/2004 Thompson ..... 221/56
6,772,909 B2 * 8/2004 Bateman ..... 221/305
6,915,923 B1 * 7/2005 Magid ..... 221/56
7,000,802 B2 * 2/2006 Kringel et al. ..... 221/35
7,090,096 B2 * 8/2006 Simpson ..... 221/45

* cited by examiner

BAG DISPENSER

FIELD OF THE INVENTION

The present invention relates generally to containers for dispensing items, and more particularly to a container for dispensing plastic bags.

BACKGROUND OF THE INVENTION

Plastic film bags are widely used in retail sales, supermarkets, and other similar applications to store and carry items such as goods purchased by consumers. Due to the various beneficial qualities of plastic bags, many retailers have switched from using paper bags to using plastic bags. While plastic bags provide durable, economic, and aesthetically pleasing alternatives to paper bags, an ongoing problem has been how to conveniently and efficiently package and dispense the plastic bags. In particular, adjacent plastic bags exhibit very little friction between one another and thus tend to slide relatively easily over one another when provided in a stack. Accordingly, plastic bags do not tend to stack well, either horizontally or vertically without requiring additional support. In this sense, the stack direction (horizontal, vertical) refers to the direction normal to the plane of a flat bag. To address this stacking problem, various dispensers have been developed. For example, some prior dispensers utilize various retaining fixtures, such as hanger rods or staples, to help secure and support plastic bags within the dispenser. These additional fixtures increase complexity of the dispensers and generally increase the cost of the dispensers such that the economic benefit of using plastic bags is diminished. Some prior dispensers are also bulky, making it difficult to transport and store the dispensers prior to filling them with plastic bags.

Another problem associated with dispensing plastic bags is that plastic bags are generally unable to be oriented in an upstanding fashion (a horizontal stack) due to the inherent low stiffness/rigidity of the plastic film material used to form the bags. Even when they are provided in a dispenser, plastic bags tend to settle toward the bottom of the dispenser after several bags have been initially removed from the dispenser. This settling makes removal of the bags from the dispenser difficult.

There is thus a need for an improved dispenser for dispensing plastic bags which overcomes drawbacks of the prior art, such as those discussed above.

SUMMARY OF THE INVENTION

The present invention provides a dispenser for dispensing plastic bags that are provided in a stack. The dispenser if formed from a single sheet of material that is cut and formed with appropriate fold lines such that it can be folded into a carton having a bottom wall, spaced opposing front and back walls extending generally perpendicularly from the bottom wall, and spaced opposing sidewalls extending generally perpendicular from the bottom wall, and disposed perpendicular to the front and back walls. The bottom wall, front and back walls, and sidewalls define a receptacle for receiving a stack of bags. An opening to the receptacle is provided to facilitate dispensing the bags from the receptacle.

The carton further includes an interior flap extending within the receptacle, between the front and back walls. The flap is configured to engage the stack of bags disposed within the receptacle and to urge the stack of bags in a direction toward one of the front and back walls. Advantageously, the flap helps to maintain the stack of bags in an upstanding orientation within the receptacle so that individual bags may be easily removed from the dispenser.

In an exemplary embodiment, the carton includes two interior flaps, each hingedly joined to the front wall by fold lines and biased in a direction toward the back wall. The fold lines joining the flaps to the front wall may extend in directions parallel or perpendicular to the sidewalls of the carton. In another aspect of the invention, the interior flaps have widthwise dimensions that are greater than a widthwise dimension of the sidewalls, whereby the interior flaps form acute angles with one of the front and back walls.

In yet another aspect of the invention, the front wall of the carton comprises first and second front panel sections that are hingedly joined to respective sidewalls of the carton. The interior flaps are hingedly joined to the respective front panel sections to extend between the front and back walls as described above.

In another aspect of the invention, a bag dispenser comprises a carton having a bottom wall, spaced opposing front and back walls, spaced opposing sidewalls, and at least one interior flap extending between the front and back walls, and further comprising a plurality of bags stacked within the carton and engaged by the flap to maintain the stack in an upstanding orientation within the carton. These and other advantages, objectives and features of the present invention will become more readily apparent to those of ordinary skill upon review of the following detailed description and accompanying drawings.

BRIEF DESCRIPTION OF THE DRAWINGS

The accompanying drawings, which are incorporated in and constitute a part of this specification, illustrate embodiments of the invention and, together with a general description of the invention given above, and the detailed description given below, serve to explain the invention.

DETAILED DESCRIPTION

Figure 1:
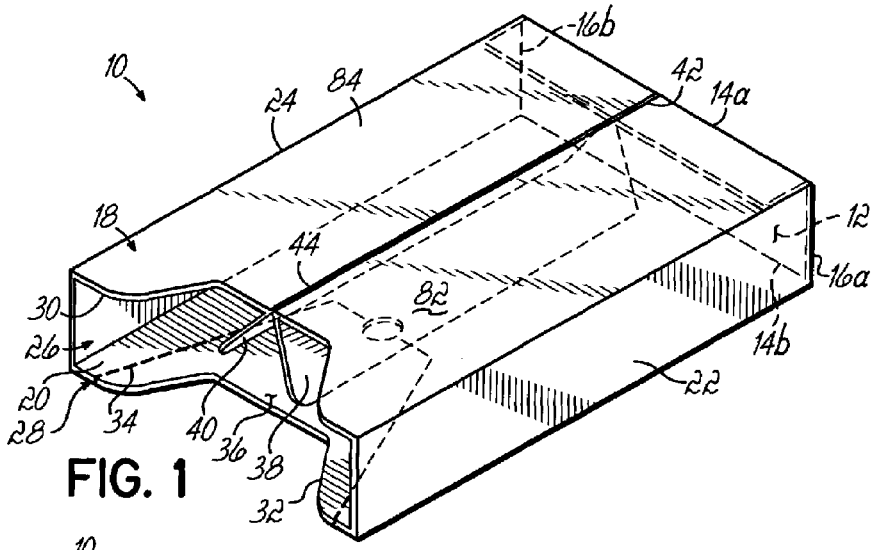
FIG. 1 is a perspective view of an exemplary carton for dispensing bags, according to the present invention.

Referring to FIG. 1, there is shown an exemplary carton 10 for dispensing plastic bags, according to the present invention. In the exemplary embodiment shown, the carton 10 is formed from a single sheet or blank of material, such as corrugated cardboard, which has been cut and folded to create the dispenser. It will be recognized, however, that carton 10 may be formed from other materials, such as plastic sheet, corrugated plastic, or other suitable materials. The carton 10 includes a bottom wall 12 having spaced, opposing bottom wall end edges 14*a*, 14*b* and spaced, opposing bottom wall side edges 16*a*, 16*b*. Spaced, opposing front and back walls 18, 20 are disposed generally perpendicular to the bottom wall 12 along the respective end edges 14*a*, 14*b* of the bottom wall 12. The carton 10 further includes first and second spaced opposing sidewalls 22, 24 adjacent the front and back walls 18, 20 and adjacent the bottom wall 12. The sidewalls 22, 24 are disposed generally perpendicular to the bottom wall 12 along the respective side edges 16*a*, 16*b* of the bottom wall 12, and perpendicular to the sidewalls 22, 24.

Figure 2A:
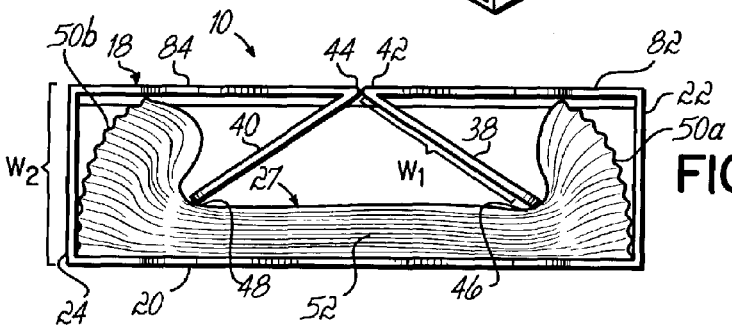
FIG. 2A is an end view of the carton of FIG. 1, illustrating the carton filled with bags.

The bottom wall 12, the front and back walls 18, 20, and the first and second sidewalls 22, 24 define a receptacle 26 of the carton 10 for receiving a stack of plastic bags 27 therein, as depicted in FIG. 2A. While the container 10 is described herein with regard to a bottom wall, front and back walls, and first and second sidewalls, this nomenclature is for relative descriptive purposes only. One of ordinary skill in the art will recognize that the structure of the carton may alternatively be described by various other nomenclature. Accordingly, the nomenclature used herein is not intended to restrict the scope of the invention.

The carton 10 has an opening 28 which provides access to the receptacle 26 whereby plastic bags stored in the carton 10 may be individually removed from the receptacle 26 as desired. Edges of the carton 10 adjacent the opening 28 may be contoured to facilitate grasping and dispensing individual bags from the receptacle 26. For example, end edges 30, 32 of the front and back walls 18, 20, respectively, in the embodiment of FIG. 1 are contoured inwardly of the receptacle 26 to facilitate dispensing bags.

In the exemplary embodiment shown, a tear perforation 34 is formed into the back wall 20, adjacent the opening 28, to define a panel section 36 that may be removed to further facilitate dispensing bags from the carton 10. Advantageously, the removable panel section 36 defined by the perforation 34 may be left in place to facilitate shipping and storing of a carton 10 of plastic bags, and subsequently removed to facilitate dispensing of the bags as needed. While a single removable panel section 36 is depicted in the exemplary embodiment, it will be recognized that additional perforations may be formed in any of the first and second sidewalls 22, 24, the front wall 18, or the bottom wall 12 to create additional removable panel sections to facilitate dispensing of the bags.

Figure 2B:
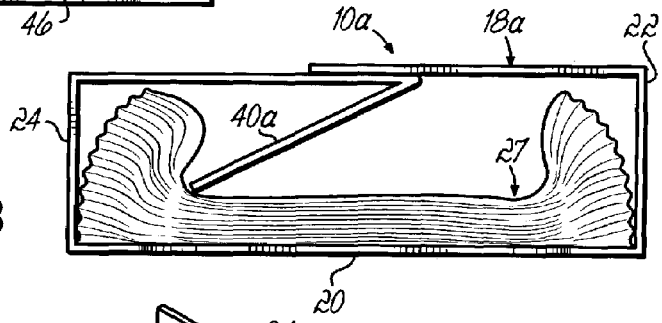
FIG. 2B is an end view, similar to FIG. 2A, depicting an alternative carton of the present invention.

Advantageously, the carton 10 further includes at least one interior flap disposed within the receptacle 26 and extending generally between the front and back walls 18, 20. In the exemplary embodiment shown in FIG. 1, the carton 10 has first and second interior flaps 38, 40, but it will be recognized that the carton 10 may include a single flap 40*a*, as depicted by the alternative exemplary carton 10*a* shown in FIG. 2B, or may have more than two flaps. In FIG. 2B, features of carton 10*a* that are similar to features of carton 10 have been similarly numbered.

With continued reference to FIGS. 1 and 2A, the carton 10 is configured such that the first and second interior flaps 38, 40 have a widthwise dimension W1 which is greater than the widthwise dimensions W2 of the first and second sidewalls 22, 24. Accordingly, when the carton 10 is assembled, the interior flaps 38, 40 are positioned to extend between the front and back walls 18, 20 in an orientation which forms generally acute angles with the front and back walls 18, 20. The first and second interior flaps 38, 40 are hingedly joined to the front panel 18 by fold lines 42, 44 that extend in a direction substantially parallel to the first and second sidewalls 22, 24 of the carton 10 and each flap 38, 40 is folded toward its respective adjacent sidewall 22, 24 such that distal edges 46, 48 of the respective flaps 38, 40 are biased in a direction toward the back wall 20. Thus, when a stack of plastic bags 27 is disposed in the receptacle 26, the interior flaps 38, 40 engage the stack of bags 27 and urge the stack of bags 27 in a direction toward the back wall 20. In this manner, the interior flaps 38, 40 help to maintain the stack of bags 27 in an upstanding orientation within the receptacle 26 of the carton 10 when carton 10 is positioned to stand upright on bottom wall 12. Because the interior flaps 38, 40 are biased toward the back wall 20, the flaps 38, 40 maintain the bags securely against the back wall 20 even after several of the bags have been removed from the receptacle 26.

The exemplary carton 10 shown in FIGS. 1 and 2A is particularly useful for supporting plastic bags in an upstanding orientation within the receptacle 26 when the bags are constructed to have pleated sidewalls that permit the bag to be expanded for receiving contents therein. When this type of bag is stacked one upon another, the additional thickness of the pleated sidewalls of the bags causes the thickness of the stack 27 to be greater along the side edges 50*a*, 50*b* of the stack of bags 27 relative to a central portion 52 of the stack 27. Advantageously, the exemplary embodiment shown in FIGS. 1 and 2A facilitates storing and dispensing of this type of plastic bag, whereby the interior flaps 38, 40 engage the central portion 52 of the stack 27 and cooperate with the increased thickness along the sides 50*a*, 50*b* of the stack of bags 27 to help maintain the bags in an upstanding orientation within the receptacle 26, as depicted in FIG. 2A.

In the exemplary embodiment shown in FIGS. 1, 2A, 3 and 4, the front wall 18 of the carton 10 comprises first and second front panel sections 82, 84 arranged to form the front wall 18. In this embodiment, each of the first and second interior flaps 38, 40 is hingedly joined to one of the first and second front panel sections 82, 84 as depicted most clearly in FIGS. 1 and 2A.

Figure 4:
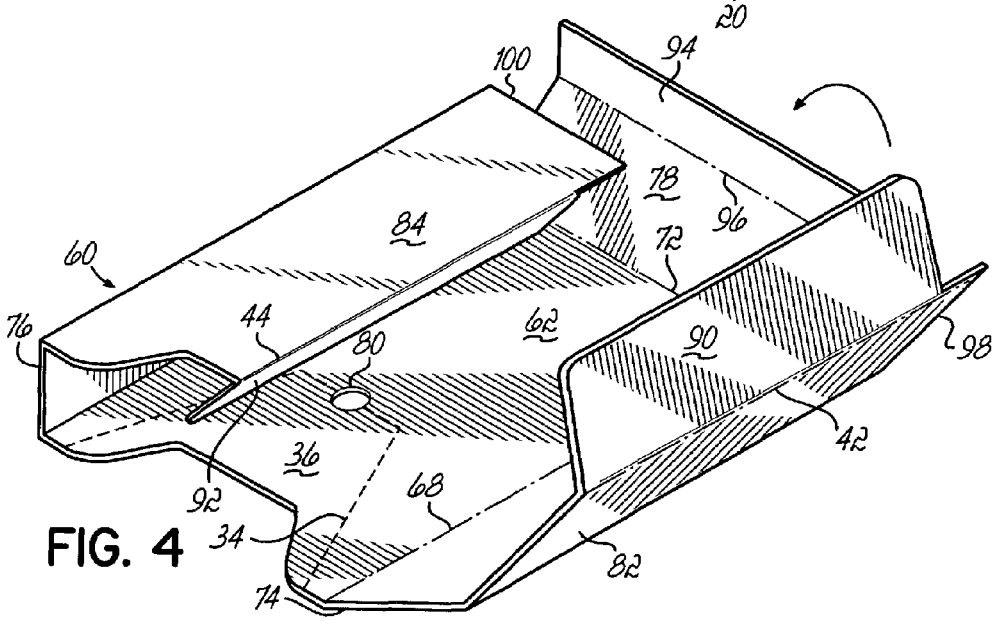
FIG. 4 is a perspective view of the blank of FIG. 3, partially folded to form the carton of FIG. 1.
Figure 3:
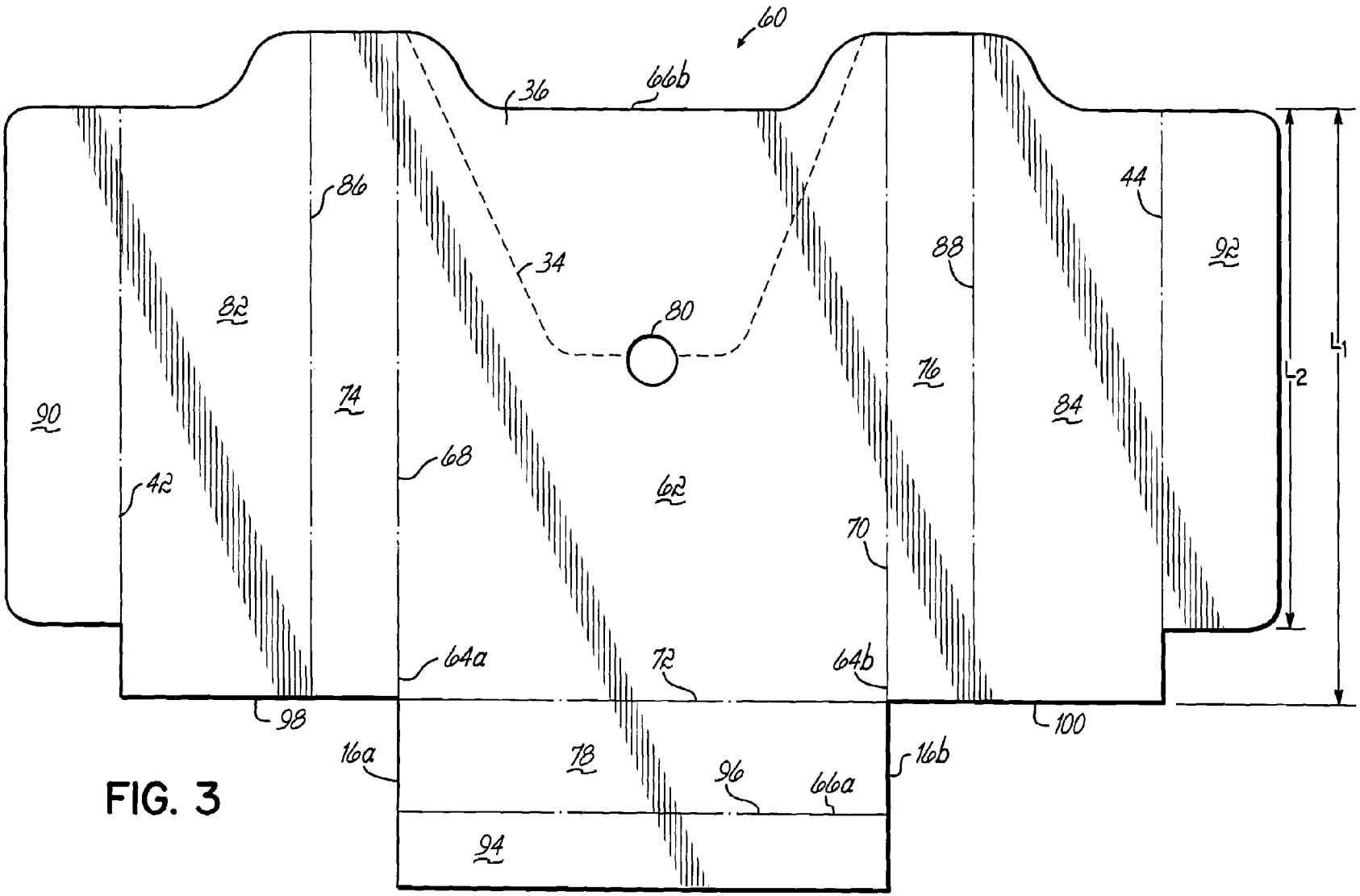
FIG. 3 is a plan view of an exemplary blank for forming the carton of FIG. 1.

The exemplary carton 10 of FIG. 1 is formed by folding a blank 60 comprising a single sheet of material which has been appropriately shaped, die cut, and provided with properly located fold lines as illustrated in FIGS. 3 and 4. Referring now to FIG. 3, the blank 60 includes a back panel 62 having first and second side edges 64*a*, 64*b* and a bottom edge 66*a* defined by respective fold lines 68, 70, 72 formed in the sheet of material. A top edge 66*b* of the back panel 62 is contoured to provide a shape that facilitates removal of bags from the carton 10 formed by folding the blank 60. First and second side panels 74, 76 and a bottom panel 78 are hingedly joined to the back panel 62 along the respective first and second side edges 64*a*, 64*b* and the bottom edge 66*a* of the back panel 62. Perforations 34 formed through the back panel 62 define a removable panel section 36 that may be removed from the assembled carton 10, if desired, to further facilitate the dispensing of bags provided in the carton 10 as described above. An aperture 80 formed through the back panel 62, proximate the perforation 34, facilitates separation of the removable panel section 36 from the back panel 62, whereby a user may insert a finger or tool through the aperture 80 to permit grasping of the removable panel section 36.

The blank 60 further includes first and second front panel sections 82, 84 disposed on opposing sides of the blank 60, adjacent respective ones of the first and second side panels 74, 76. Each front panel section 82, 84 is hingedly joined to a respective side panel 74, 76 by respective fold lines 86, 88 formed therebetween. First and second flap panels 90, 92 are provided on opposing sides of the blank 60, adjacent the respective front panel sections 82, 84. Each of the first and second flap panels 90, 92 is hingedly joined to one of the front panel sections 82, 84 by respective fold lines 42, 44 formed therebetween, as described above. A sealing panel 94 is provided adjacent the bottom panel 78 and is hingedly joined to the bottom panel 78 by a fold line 96.

To assemble the carton 10 of FIG. 1, the blank 60 is folded along the fold lines 42, 44, 68, 70, 72, 86, 88, 96 to form the rectangular box shape depicted in FIG. 1. FIG. 4 depicts a partially folded blank 60 and illustrates folding of the blank 60 to form the carton 10. Specifically, the bottom panel 78 and first and second side panels 74, 76 are folded along the end edge 66*a* and first and second side edges 64*a*, 64*b* of the back panel 62, respectively, to position the bottom panel 78 and first and second side panels 74, 76 in a substantially perpendicular relationship with respect to the back panel 62. The sealing panel 94 is folded along the fold line 96 between the sealing panel 94 and the bottom panel 78 to position the sealing panel 94 substantially perpendicular to the bottom panel 78 and parallel to the back panel 62. The first and second front panel sections 82, 84 are folded along respective fold lines 86, 88 between the front panel sections 82, 84 and the first and second side panels 74, 76 to position the front panel sections 82, 84 substantially perpendicular to their respective side panels 74, 76 and generally parallel to the back panel 62. While the front panel sections 82, 84 are folded toward one another, the first and second flap panels 90, 92 are folded inwardly toward their respective front panel sections 82, 84 along respective fold lines 42, 44. When folded in this manner, the first and second front panel sections 82, 84 are positioned to abut one another along the fold lines 42, 44 between the flap panels 90, 92 and front panel sections 82, 84 to thereby form the front wall 18 of the container 10, as depicted in FIGS. 1 and 2A. Likewise, the back panel 62, first and second side panels 74, 76, and the bottom panel 78 of the blank 60 correspond to the back wall 20, first and second sidewalls 22, 24, and bottom wall 12 of the carton 10, respectively, in the assembled condition. The first and second flap panels 90, 92 of blank 60 correspond to the first and second interior flaps 38, 40 of assembled carton 10.

As illustrated best in FIGS. 3 and 4, the first and second interior flap panels 90, 92 are not fully coextensive with the lengthwise dimensions L1 of the respective first and second front panel sections 82, 84 along the fold lines 42, 44 whereby distal end edges 98, 100 of the first and second front panel sections 82, 84 near the bottom panel 78 extend beyond the lengthwise dimensions L2 of the first and second flap panels 90, 92. The blank 60 is configured such that when it is folded as described above, portions of the first and second front panel sections 82, 84 adjacent the distal end edges 98, 100 engage the sealing panel 94 in confronting relationship while permitting the first and second flap panels 90, 92 to be freely flexed in a direction toward their respective front panel sections 82, 84.

To complete the carton 10, the folded panels of the blank 60 may be secured in the assembled condition depicted in FIG. 1. The panels may be secured in this condition, for example, by staples, tape, or adhesives, as known in the art. Alternatively, the panels of the blank 60 may be provided with slots and tabs (not shown) configured to provide an interlocking relationship between the panels in the assembled condition, as known in the art.

Advantageously, the assembled carton 10 may be used to store and dispense plastic bags, as described above. The plastic bags may be inserted into the carton 10 after it has been assembled or, preferably, a stack of plastic bags 27 may be positioned on the back panel 62 of the blank 60 prior to folding the panels to form the carton 10. The carton 10 may then be easily folded in the manner described above to create a carton 10 of plastic bags wherein the interior flaps 38, 40 of the carton 10 engage and support the plastic bags as described above.

Figure 5:
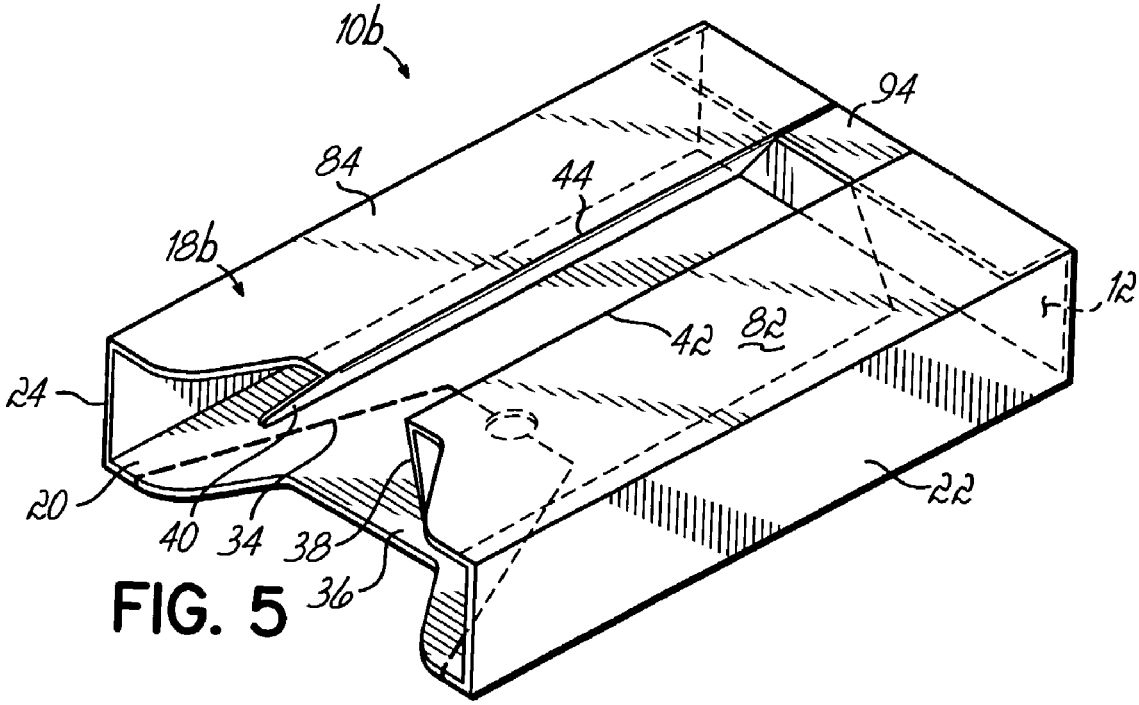
FIG. 5 is a perspective view of an exemplary carton according to an alternative embodiment of the present invention.
Figure 6:
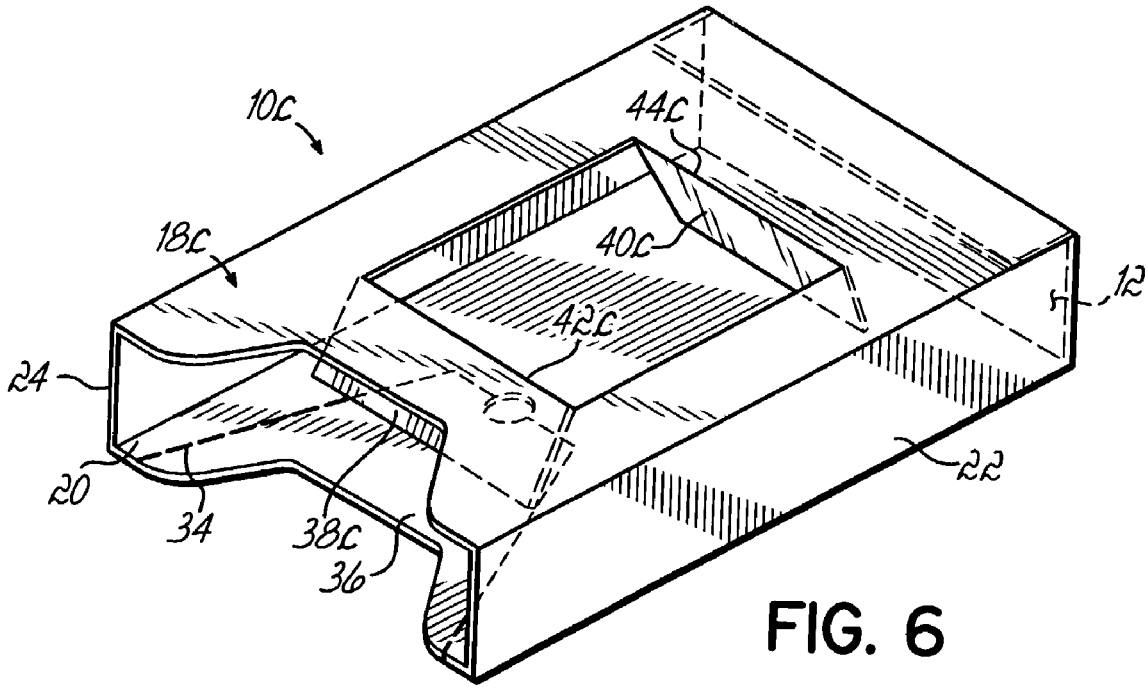
FIG. 6 is a perspective view of an exemplary carton according to yet another embodiment of the present invention.

Referring now to FIGS. 5 and 6, there are shown alternative exemplary embodiments of the dispensing carton 10*b*, 10*c* of the present invention wherein features similar to carton 10 of FIGS. 1 and 2A are similarly numbered. In FIG. 5, the exemplary carton 10*b* is similar to the carton of FIG. 1, with the exception that the first and second front panel sections 82, 84 do not abut one another along the fold lines 42, 44 formed between the respective front panel sections 82, 84 and first and second interior flaps 38, 40.

The cartons 10, 10*a*, 10*b* shown in FIGS. 1-5 each have fold lines 42, 44 formed between the respective front panel sections 82, 84 and interior flaps 38, 40 that extend in directions substantially parallel to the first and second sidewalls 22, 24. FIG. 6 depicts an exemplary embodiment of a container 10*c* according to the present invention having a front wall 18*c* formed from a single panel section, and wherein first and second interior flaps 38*c*, 40*c* are hingedly joined to the front wall 18*c* by fold lines 42*c*, 44*c* extending in directions generally perpendicular to the first and second sidewalls 22, 24.

While the present invention has been illustrated by the description of various embodiments thereof, and while the embodiments have been described in considerable detail, it is not intended to restrict or in any way limit the scope of the appended claims to such detail. Additional advantages and modifications will readily appear to those skilled in the art. The invention in its broader aspects is therefore not limited to the specific details, representative apparatus and illustrative examples shown and described. Accordingly, departures may be made from such details without departing from the scope or spirit of the general inventive concept.

What is claimed is:

1. A carton for dispensing bags provided in a stack, comprising:

a bottom wall;

spaced, opposing front and back walls disposed generally perpendicular to said bottom wall;

spaced opposing first and second sidewalls disposed generally perpendicular to said bottom wall and adjacent said front and back walls;

said bottom wall, said front and back walls, and said first and second sidewalls defining a receptacle and an opening providing access to said receptacle; and first and second interior flaps disposed within said receptacle and extending between said front wall and said back wall to thereby engage a stack of bags positioned within said receptacle such that the stack is urged toward one of said front and back walls, said first and second flaps each comprising a single panel;

wherein said front wall comprises first and second front panel sections, each of said first and second front panel sections hingedly joined to one of said first and second sidewalls, each of said first and second interior flaps hingedly joined to one of said first and second front panel sections via fold lines;

wherein said fold lines hingedly joining said first and second interior flaps to said first and second front panel sections abut one another in confronting relation whereby said first and second front panel sections form said front wall.

2. The carton of claim 1, wherein each said interior flap has an edge that is biased in a direction toward said back wall.

3. The carton of claim 1, wherein each said interior flap has a widthwise dimension that is greater than a widthwise dimension of said first and second sidewalls, whereby each said interior flap forms an acute angle with at least one of said front and back walls.

4. The carton of claim 3, wherein each said interior flap extends between said front and back walls such that alternate interior angles formed by said flap and said front and back walls are acute angles.

5. The carton of claim 1, wherein each said flap is hingedly joined by a hinge line formed along a direction substantially parallel to said first and second sidewalls.

6. The carton of claim 1, wherein each said flap is hingedly joined by a hinge line formed along a direction substantially perpendicular to said first and second sidewalls.

7. The carton of claim 1, wherein said opening is defined by an open end substantially opposite said bottom wall.

8. The carton of claim 1, formed from:

a single sheet of material cut and formed into a blank to define a back panel, a bottom panel, first and second opposing side panels, a front panel, and first and second flap panels;

said back panel having opposing end edges and opposing side edges;

said bottom panel hingedly joined to said back panel by a fold line formed along one of said opposing end edges of said back panel;

said first and second opposing side panels respectively hingedly joined to said back panel by respective fold lines formed along said opposing side edges of said back panel;

said front panel hingedly joined to at least one of said first and second side panels along a fold line formed therebetween; and each said flap panel hingedly joined to said front panel along a fold line formed therebetween.

9. The carton of claim 1, further comprising:

a plurality of bags stacked within said receptacle and engaged by said interior flaps, whereby said interior flaps urge said bags in a direction toward one of said front and back walls.

10. The carton of claim 1, further comprising:

a plurality of bags stacked within said receptacle and engaged by said interior flaps, whereby said interior flaps urge said bags in a direction toward one of said front and back walls.

* * * * *